United States Patent [19]

Yamada et al.

[11] Patent Number: 4,823,161

[45] Date of Patent: Apr. 18, 1989

[54] CLEANING BLADE FOR ELECTROPHOTOGRAPHIC COPYING MACHINES OR THE LIKE

[75] Inventors: Yoshio Yamada, Takatsuki; Mitsuaki Hashiyama, Otsu, both of Japan

[73] Assignees: Toyo Tire & Rubber Co., Ltd., Osaka; Ricoh Co., Ltd., Tokyo, both of Japan

[21] Appl. No.: 136,987

[22] Filed: Dec. 23, 1987

[30] Foreign Application Priority Data

Dec. 23, 1986 [JP] Japan ..... 61-314652

[51] Int. Cl.[4] ..... G03G 15/08

[52] U.S. Cl. ..... 355/15; 355/3 DD; 118/652; 430/125; 15/256.5

[58] Field of Search ..... 355/15, 3 DD, 14 D; 15/256.51; 118/652; 430/125; 528/902, 905, 906

[56] References Cited

U.S. PATENT DOCUMENTS

| | | | |
|---|---|---|---|
| 4,083,633 | 4/1978 | Shanly | 355/15 |
| 4,218,131 | 8/1980 | Ito et al. | 355/15 |
| 4,247,196 | 1/1981 | Ogawa et al. | 355/15 |
| 4,284,345 | 8/1981 | Sugiyama et al. | 355/15 |
| 4,417,365 | 11/1983 | Murasaki | 15/256.51 |
| 4,469,434 | 9/1984 | Yamazaki et al. | 355/15 |
| 4,537,130 | 8/1985 | Theilacker | 15/256.51 X |
| 4,630,328 | 12/1986 | Croteau | 15/256.51 X |
| 4,639,123 | 1/1987 | Adachi et al. | 355/15 |

*Primary Examiner*—A. C. Prescott

*Attorney, Agent, or Firm*—Armstrong, Nikaido, Marmelstein & Kubovcik

[57] ABSTRACT

The present invention provides a cleaning blade for use in electrophotographic copying machines, facsimile machines, printers or the like which is characterized in that it has a double-layer structure and comprises a contact member made of a poly(urethane)ureamide polymer and to be held in contact with a toner image bearing member, and a support member for the contact member having the same hardness or substantially the same hardness as the contact member and lower than the contact member in glass transition temperature.

9 Claims, 2 Drawing Sheets

CLEANING BLADE FOR ELECTROPHOTOGRAPHIC COPYING MACHINES OR THE LIKE

The present invention relates to a cleaning device for removing residual toner from the surface of a photosensitive member, more particularly to a cleaning device for use in electrophotographic copying machines, facsimile machines, printers or the like, and especially to a cleaning blade having a long life.

For example, in electrophotographic copying machines, copy images are formed with use of a toner, and the toner remaining on the surface of the photosensitive member is removed by a cleaning device.

The cleaning devices heretofore known include those of the fur brush type, magnetic brush type and blade type. These types are used singly or in combination for electrophotographic copying machine. The fur brush type and the magnetic brush type, despite their advantages, have the drawbacks of being large-sized and costly, so that cleaning devices of the blade type which are less disadvantageous are generally in wide use. Nevertheless, blade-type cleaning devices have drawbacks. The edge of the blade wears away owing to frictional contact with the surface of the photosensitive member, resulting in a gradually decreasing cleaning effect. Owing to variations in the characteristics with temperature, the blade gives off a noise at high temperatures or exhibits a diminished cleaning effect at low temperatures. When used for a prolonged period of time, the blade displays an impaired cleaning effect due to creeping.

While elastic materials are usually used for the blade, polyurethane elastomers which are less prone to the foregoing drawbacks are generally in use. However, with the development of electrophotographic copying machines which are operable with a higher efficiency at a higher speed, more sophisticated performance is required of the blade. Especially, high-speed machines used for producing an increased number of copies require a cleaning blade of longer life.

It is difficult to fulfill all of these requirements using a single material in the form of a single layer. It is therefore desirable to construct the cleaning blade with a plurality of layers of different materials each meeting a particular characteristics requirement.

From this viewpoint, cleaning blades of multilayer structure have been developed. Examined Japanese Patent Publication No. 14892/1975, for example, discloses a flexible blade having affixed thereto a material of higher hardness than the blade for giving an adjusted coefficient of friction or modulus of elasticity, for use in electrophotographic cleaning devices. Examined Japanese Patent Publication No. 15377/1978 discloses a cleaning blade for electrophotographic copying machines which comprises a sheet and a solid material having a coefficient of friction of up to 0.8 and laminated to the sheet to achieve a cleaning effect. Unexamined Japanese Patent Publication No. 133470/1982 discloses a cleaning device for electrophotographic copying machines or the like which includes a cleaning blade effectively usable for a long period of time. The blade comprises a member of small elastic modulus and another member having a greater modulus of elasticity and adapted for contact with the surface of a toner image bearing member. Unexamined Japanese Patent Publication No. 165682/1985 discloses a cleaning blade which is said to be effective for cleaning the surface of a drum for long-term use and which comprises an elastic cleaning member of rubber having high abrasion resistance and a relatively low value of about 50 to about 70 in JIS-A hardness, and an elastic support member having high creep resistance and a relatively high value of about 70 to about 90 in JIS-A hardness. Unexamined Japanese Utility Model Publication No. 115761/1983 discloses a cleaning blade which is characterized in that it comprises an edge portion to be held in contact with an image bearing member and a base portion other than the edge portion, the two portions being made of elastic materials of different hardnesses. Unexamined Japanese Utility Model Publication No. 87073/1984 discloses a doctor blade for use with a platen characterized in that it comprises a laminate of a soft elastic material and a hard elastic material, with the soft elastic material adapted for contact with the surface of the platen roll.

The blade of the above Publication No. 15377/1978 is characterized in that the solid material of low coefficient of friction is laminated to the sheet. Although nothing is mentioned about the hardness in this publication, the blades of the other publications are each made of two materials which are different in hardness (modulus of elasticity).

However, for the blade to retain the desired cleaning ability for a prolonged period of time, it is required that the member to be held in contact with the surface of the toner image bearing member have high abrasion resistance, so that a noticeable effect will not be obtained by merely constructing the blade with two layers.

Further even when two members of different hardnesses are laminated for use as a cleaning blade, one of the members is liable to the concentration of stress and consequently excessively loaded, with the resulting tendency for the blade to have a shorter life than is expected.

An object of the present invention is to provide a cleaning blade for use in electrophotographic copying machines or the like which comprises a member having greatly improved abrasion resistance and adapted for contact with the surface of a toner image bearing member.

Another object of the invention is to provide a cleaning blade of double-layer structure for use in electrophotographic copying machines or the like which is operable without the concentration of stress on one of the layers.

The above and other objects of the invention will become apparent from the following description.

The present invention provides a cleaning blade for use in electrophotographic copying machines, facsimile machines, printers or the like which is characterized in that it has a double-layer structure and comprises a contact member made of a poly(urethane)ureamide polymer and to be held in contact with a toner image bearing member, and a support member for the contact member having the same hardness or substantially the same hardness as the contact member and lower than the contact member in glass transition temperature.

The present cleaning blade is explained with reference to drawings. FIG. 1 is a diagram showing a cleaning blade embodying the invention as it is used in sliding contact with a toner image bearing member in a trailing mode and FIG. 2 is a similar diagram showing another cleaning blade of the invention for use in a counter mode. In the figures, 1 is a contact member which is held in contact with a toner image bearing member, 2 is a support member for the contact member, 3 is a mount member for the cleaning blade, 4 is a toner image bearing member and 5 is a edge portion of the contact member.

FIG. 3 is a diagram showing a cleaning device for use in electrophotographic copying machines, facsimile machines, printers or the like in which a drum-type toner image bearing member is used, and FIG. 4 is a diagram showing a cleaning device for use in the same machines or the like in which a belt-type toner image bearing member is used. In the figures, 6 is a drum-type toner image bearing member, 7 is a belt-type toner image bearing member, 8, 9 and 10 are chargers, 11 is a fur brush, 12 and 13 are cleaning blades, 14 and 15 are mount members, 16 is a scavenging roller, 17 is a screw, 18 is a blade edge cleaner, 19 is a developer, 20 is a sleeve, 21 is an exposure, 22, 23 and 24 are rollers.

The poly(urethane)ureamide polymer to be used in this invention for the contact member adapted for contact with the surface of the toner image bearing member is preferably a poly(urethane)ureamide polymer (hereinafter reffeerd to as "polymer A") disclosed, for example, in Unexamined Japanese Patent Publication No. 126124/1986 (U.S. patent application Ser. No. 797,665).

Polymers A are poly(urethane)ureamide polymers containing polymers obtained by the reaction of a polyesterpolyol derivative with a polyisocyanate. The polyesterpolyol derivatives are represented by the formula [I]

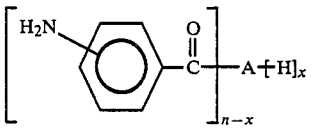

[I]

wherein A is a polyesterpolyol residue having a valence of n and obtained by removing the terminal H atom from a polyesterpolyol having a valence of n and a molecular weight of 400 to 10000 and containing

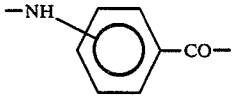

group in its main chain, n is an integer of 2 to 4, and X is an average value of 0 to (n−1), the group —NH— in the group

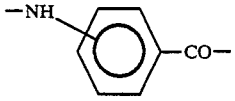

being adjacent to the carbonyl residue of aminobenzoic acid and/or the carbonyl residue of a polybasic acid of polyesterpolyol to form an amido group, the group —CO— forming an ester group or amido group.

Polymer A can be prepared by any of processes known in polyurethane chemistry, by a polyaddition reaction of a polyisocyanate and the polyesterpolyol derivative of the formula [I]which has amino and optionally hydroxyl groups in the ends of the molecule and further having aromatic amido groups in the main chain. For example, the polyaddition reaction may be conducted in the presence of an active hydrogen-containing compound which is capable of reacting with isocyanate group. Further, any of known additives in polyurethane chemistry may be added such as a catalyst, fire retardant, plasticizer, filler, blowing agent, antioxidant, pigment, inert organic solvent, etc.

In case of the production of an elastomer in the invention, it is preferable to conduct the reaction in the presence of a suitable chain extender. The chain extender includes a 2- to 4-valent polyol having a molecular weight of up to 400, diamine having a primary or secondary terminal amino group and a molecular weight of up to 400.

In the invention, it is further possible to use a known active hydrogen-containing compound such as a long-chain polyol, polyamine, aminopolyol, etc. Preferred long-chain polyols have a molecular weight of more than 400 and at least one hydroxyl group. Examples of useful polyols are polyesterpolyols, polyoxyalkylenepolyols and polycarbonatepolyols each having a molecular weight of 400 to 10,000 and 2 to 8 valencies. Preferable polyesterpolyols are polyethylene adipate polyol, polybutylene adipate polyol, polyethylenebutylene adipate polyol and poly ϵ-caprolactone polyol, polyoxyalkylenepolyols are polyoxyethylenepolyol and polyoxypropylenepolyol, polycarbonatepolyols are polycarbonatepolyol obtained by the reaction of dimethylcarbonate and hexamethylenediol, etc. Preferable long-chain polyamines have a molecular weight of more than 400 and at least one amino group. Examples thereof are polyether polyamines obtained by the reaction of ammonia or the like with a terminal hydroxyl group of polyoxyalkylenepolyol, polyether polyamines prepared by reacting ethyleneimine or the like with a known polyol, etc. Long-chain aminopolyols have a molecular weight of more than 400 and both of amino and hydroxyl groups in the molecule. Examples thereof are aminopolyols obtained by coverting a part of hydroxyl groups of a polyol into an amino group by the above-mentioned method. Further, preferably usable are polyetherpolyol derivatives having at least one terminal aminobenzoic acid ester group which are disclosed in Japanese Kokai No. 53,533/1984.

The hardness of the contact member is preferably in the range of 60 to 90, more preferably 70 to 80, in JIS-A hardness. When the member has lower hardness, the contact portion (edge) of the blade is liable to chip, whereas if the member is harder, the blade is likely to deface the toner image bearing member.

The support member for the contact member has the same hardness or substantially the same hardness as the contact member and is lower than the contact member in glass transition temperature (Tg). Materials useful for forming the support member with such properties are usual urethane elastomers, silicone elastomers, and elastomers of flexible epoxy resin, flexible nylon resin, etc.

As the urethane elastomers are used those described in Polyurethanes Chemistry and Technology, Part II Interscience Publishers. Useful silicone elastomers, flexible epoxy resin elastomers and flexible nylon resin elastomers are disclosed, for example, in Reinhold Plastics Applications Series, Silicones, Epoxy Resins and Polyamide Resins, Reinhold Publishing Corporation. While any of these materials are usable, urethane elastomers are more desirable to use.

The two members as individually molded may be adhered together with a known adhesive or fixed together in a known manner by a mount member. Alternatively, the two members may be adhered together by curing while being molded. In this way, the blade of the invention having a double-layer structure can be prepared.

The cleaning blade of the invention retains high cleaning ability over a prolonged period of time since the contact member has outstanding abrasion resistance. This advantage has been ascertained by testing the blade as installed in electrophotographic copying machines in a continuous mode and intermittent mode.

The present blade retains high cleaning ability for a long period partly because the amount of wear of the contact member edge portion is as small as $\frac{2}{3}$ to $\frac{1}{2}$ the amount of wear of the polyurethane elastomer blade conventionally used. The blade can be checked for the amount of wear by microscopically observing the edge portion at a given time interval during copying operation and measuring the width of wear. The above advantage is attributable also to the fact that the contact member is much less likely to cause filming (phenomenon that the toner left unremoved by the blade forms a thin film on the surface of the toner image bearing member, adversely affecting the copy image to be produced) than the conventional polyurethane elastomer member. When microscopically observed after use, the polyurethane elastomer member is found to have a ragged worn edge with irregularities like the one produced by polishing with a coarse grindstone, but the member of the invention made of the poly(urethane)ureamide polymer exhibits a uniformly worn edge with diminished irregularities. Accordingly, the outstanding antifilming property of the present member appears attributable to the uniformly worn edge with diminished irregularities which is less likely to permit the toner to remain unremoved.

Although the contact member of the present cleaning blade has the above advantageous feature, it has the drawback of being slightly high in glass transition temperature. This drawback can be remedied by laminating the member to an elastomer lower than the member in glass transition temperature but equivalent thereto in hardness. The member is then given satisfactory characteristics as a cleaning blade in the range of its operating temperatures, especially at lower temperatures in the range.

The cleaning blade of the invention will be described with reference to the following examples and comparative examples to specifically clarify the advantages thereof over conventional cleaning blades.

EXAMPLES 1 to 3

Figure 1:
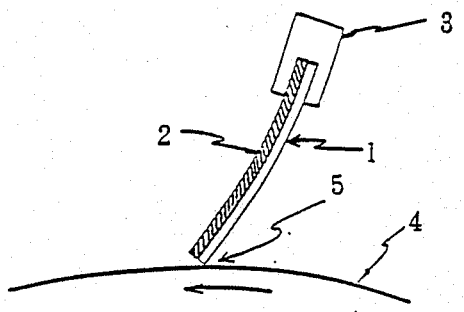
FIG. 1 is a diagram showing a cleaning blade embodying the invention as it is used in sliding contact with a toner image bearing member in a trailing mode.
Figure 2:
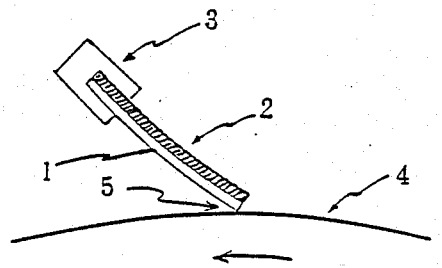
FIG. 2 is a similar diagram showing another cleaning blade of the invention for use in a counter mode.
Figure 3:
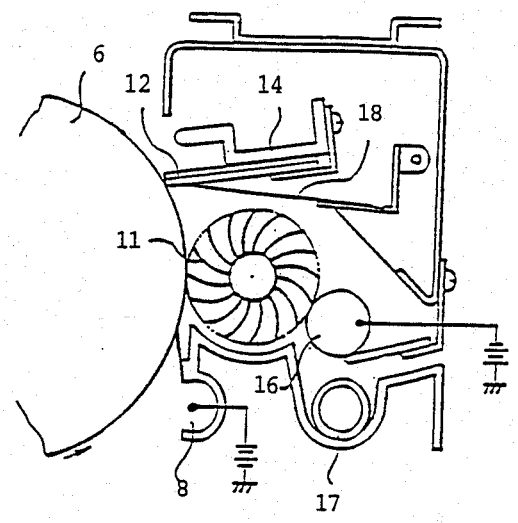
FIG. 3 and 4 are diagrams each showing a cleaning device which is provided with the cleaning blade of the present invention.
Figure 4:
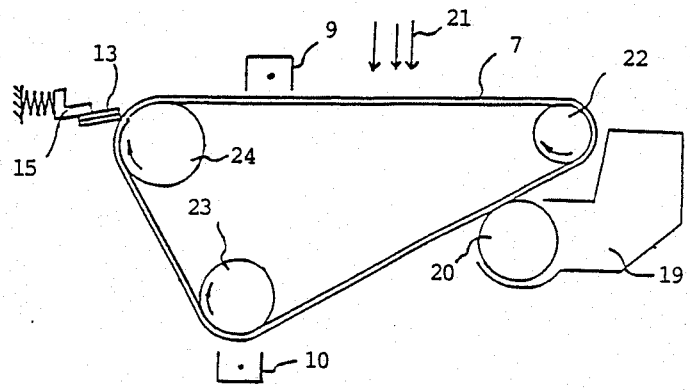

Blades of double-layer structure were prepared, each comprising a contact member and a support member for the contact member, using polymer $A_1$, $A_2$ or $A_3$ for the contact member and using for the support member urethane elastomer (polymer $B_1$, $B_2$ or $B_3$) having the same hardness or substantially the same hardness as the contact member and lower than the contact member in glass transition temperature.

Each of the blades was installed in an electrophotographic copying machine (FT6080, product of Ricoh Co., Ltd.) and tested. Tables 1 and 2 show the results.

COMPARATIVE EXAMPLES 1 AND 2

Two kinds of blades of double-layer structure were prepared by merely using usual urethane elastomers (polymers $B_3$ and $B_4$) for the contact member without using polymer A.

COMPARATIVE EXAMPLE 3

A blade of double-layer structure was prepared using polymer $A_3$ for the contact member but polymer $B_4$ which is different from the contact member in hardness for the support member.

COMPARATIVE EXAMPLE 4

A cleaning blade of single-layer structure was prepared which entirely made of polymer $B_2$.

TABLE 1

| | | Example | | | Com. Ex. | | | |
|---|---|---|---|---|---|---|---|---|
| | | 1 | 2 | 3 | 1 | 2 | 3 | 4 |
| Contact member | material | polymer $A_1$ | polymer $A_2$ | polymer $A_3$ | polymer $B_3$ | polymer $B_4$ | polymer $A_3$ | polymer $B_2$ |
| | hardness (JIS-A) | 74 | 77 | 80 | 80 | 74 | 80 | 77 |
| | Tg(°C.) | −34 | −36 | −35 | −42 | −44 | −35 | −43 |
| Support member | material | polymer $B_1$ | polymer $B_2$ | polymer $B_3$ | polymer $B_4$ | polymer $B_3$ | polymer $B_4$ | polymer $B_2$ |
| | hardness (JIS-A) | 75 | 77 | 80 | 74 | 80 | 74 | 77 |
| | Tg(°C.) | −44 | −43 | −42 | −44 | −42 | −44 | −43 |
| Properties after 30,000 copying cycles | | | | | | | | |
| (a) Width of wear (*1) | | 0.72 | 0.60 | 0.68 | 0.94 | 0.98 | 0.82 | 1.00 |
| (b) Antifilming property (*2) | | 7 | 8 | 8 | 5 | 5 | 6 | 4 |
| (c) State of wear (*3) | | A | A | A | B | B | B | C |
| (d) State of copy images | | good | good | good | slightly poor | slightly poor | slightly poor | poor |

For testing the copying machine FT6080 was operated in an intermittent mode (wherein the motor assembly was completely stopped after making each copy, and thereafter started up again for the next copy).

In the above, polymers $A_1$ to $A_3$ and polymers $B_1$ to $B_4$ are prepared by the following formulations.

| | |
|---|---|
| Polymer $A_1$: | |
| Prepolymer obtained from Nippollan 4040 (4.848 kg) and 4,4'-diphenylmethanediisocyanate (MDI)(5.152 kg) | 10.0 kg |
| Nippollan 4040 | 0.26 kg |
| Placcel 320 | 4.087 kg |
| 1,4-Butanediol | 0.978 kg |
| Polyesterpolyol obtained in Reference Example 1 later-mentioned | 5.108 kg |
| Polymer $A_2$: | |
| Prepolymer obtained from Nippollan 4040 (4.706 kg) and MDI (5.294 kg) | 10.0 kg |
| Nippollan 4040 | 1.222 kg |
| Placcel 320 | 2.654 kg |
| 1,4-Butanediol | 1.092 kg |
| Polyesterpolyol obtained in Reference Example 1 later-mentioned | 4.990 kg |
| Polymer $A_3$: | |
| The same prepolymer as in polymer $A_2$ | 10.0 kg |
| Placcel 320 | 2.576 kg |
| 1,4-Butanediol | 1.291 kg |
| Polyesterpolyol obtained in Reference Example 2 later-mentioned | 5.501 kg |
| Polymer $B_1$: | |
| Prepolymer obtained from Nippollan 4040 (5.714 kg) and MDI (4.286 kg) | 10.0 kg |
| Nippollan 4040 | 2.967 kg |
| Placcel 330 | 3.472 kg |
| 1,4-Butanediol | 0.922 kg |
| Polymer $B_2$: | |
| Prepolymer obtained from Nippollan 4070 (5.714 kg) and MDI (4.286 kg) | 10.0 kg |
| Nippollan 4070 | 0.799 kg |
| Placcel 330 | 2.960 kg |
| 1,4-Butanediol | 1.043 kg |
| Polymer $B_3$: | |
| The same prepolymer as in polymer $B_1$ | 10.0 kg |
| Nippollan 4040 | 1.447 kg |
| Placcel 330 | 3.113 kg |
| 1,4-Butanediol | 1.007 kg |
| Polymer $B_4$: | |
| The same prepolymer as in polymer $B_1$ | 10.0 kg |
| Nippollan 4040 | 3.403 kg |
| Placcel 330 | 3.575 kg |
| 1,4-Butanediol | 0.898 kg |

REFERENCE EXAMPLE 1

Into a four-necked flask equipped with a stirrer, condenser, thermometer and nitrogen gas-introducing pipe was placed 2442g(4,935eq) of a lactone-type polyesterpolypol [Placcel-210, a product of Daicel Chemical Industry Co., Ltd., MW 990, OH value 2.02 meq/g]. The polyesterpolyol was dehydrated by heating at 100° C. for 1 hour under a stream of nitrogen gas at a reduced pressure. Thereto was added 570.5g(3.46 moles) of ethyl p-aminobenzoate [a product of Nakalai Chemical Industry Co., Ltd., first-grade reagent] and the mixture was heated to 88° C.

To the mixture was added 1.025g(340ppm) of tetrabutyl titanate and the mixture was heated with stirring. The mixture became homogeneous at 110° C. and the flask wall was wetted with ethanol formed. The mixture was further heated and reacted at 225° to 230° C. for 2.5 hours to remove ethanol.

Then, the mixture was cooled to 138° C. and reduced to 7 mmHg under a stream of nitrogen gas. The mixture was again heated to 200° C. to remove unreacted ethyl p-aminobenzoate for 3 hours. A 2854g-quantity of red brown liquid was obtained having a viscosity of 11,000cps at 30° C.

Analysis of the liquid with gel permeation chromatography showed no free ethyl p-aminobenzoate. The liquid was confirmed to be a polyesterpolyol derivative having terminal amino groups by the following method.

An amine value of the product was 0.998meq/g by a titration with use of perchloric acid in glacial acetic acid according to Handbook of Japan Analytical Chemistry, third edition, page 261. A total amount of hydroxyl group and amino group (active hydrogen value) was 1.277meq/g by hydroxyl value measuring method (JIS K 1557). These found values were inconsistent with an amine value (1.213 meq/g) and an active hydrogen value (1.728 meq/g) which were calculated from the amounts of the starting polyesterpolyol and ethyl p-aminobenzoate. The obtained polyesterpolyol derivative having terminal amino groups was determined to have a molecular weight of 1566 from the found active hydrogen value of 1.277 meq/g. Further, the product was confirmed by gel peameation chromatography to have a molecular weight distribution which shifted to a high molecular weight range compared with the starting polyesterpolyol. The product was also confirmed to have amido group by $^{13}$C-NMR analysis. The amido group was 20 mole % based on the terminal amino group and nitrogen content was 1.68% by elementary analysis. The content of amido group was consistent with that calculated from a difference of a total nitrogen and amine. From the above, 78.2% of the terminal hydroxyl group of the polyesterpolyol was converted to amino group and the resulting polyesterpolyol derivative contained aromatic amido group of 20 mole % based on the terminal amino group. The following is presumed to be an average chemical formula of the product.

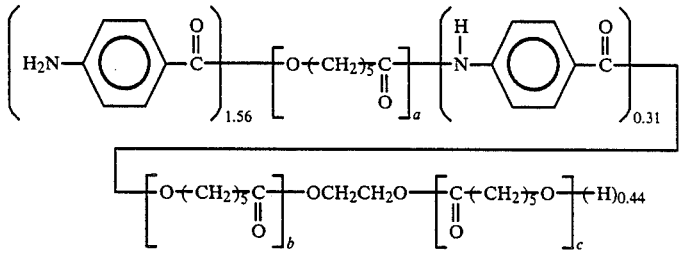

Mw 1566
a + b + c = 11.2

REFERENCE EXAMPLE 2

Into a four-necked flask was placed 699 g(0.718 eq) of a lactone-type polyesterpolyol [Placcel-220, a product of Daicel Chemical Industry Co., Ltd., MW 2000, OH value 1.027 meq/g]. The polyesterpolyol was dehydrated by heating at 100° C. for 1 hour under a stream of nitrogen gas at a reduced pressure. Thereto was added 86.0 g(0.521 mole) of ethyl p-aminobenzoate and the mixture was heated to 200° C.

To the mixture was added 0.195 g(248 ppm) of tetrabutyl titanate and the mixture was heated to 240° C. Ethanol began to be distilled off and the mixture was further heated at 235° to 240° C. for 8 hours to remove ethanol.

Then, the mixture was cooled to 200° C. and reduced to 5 mmHg under a stream of nitrogen gas. The mixture was again heated to 220° C. to remove unreacted ethyl p-aminobenzoate for 6 hours. A 601 g-quantity of red brown viscous liquid was obtained having a viscosity of 7,000 cps at 60° C.

An amine value measured in the same method as in Example 1 was 0.363 meq/g, active hydrogen value was 0.599 meq/g and nitrogen content was 0.94% by elementary analysis.

From the above, 61% of the terminal hydroxyl group of the polyesterpolyol was converted to amino group and the resulting polyesterpolyol derivative contained aromatic amido group of 85 mole % based on the terminal amino group.

Note 1 (*1): The width of wear was measured by microscopically observing the edge portion in contact with the surface of the image bearing member, at an angle of 45 degrees. The width is expressed in index relative to the width of wear of Comparative Example 4 in Table 1 which was taken as 1.00. The smaller the value, the higher is the abrasion resistance.

Note 2 (*2): The antifilming property was determined according to the density of black streaks on the copy image with reference to a standard sample. The result was evaluated in 1 to 10 grades ; the smaller the grade number, the greater is the degree of filming.

Note 3 (*3): The worn edge portion was microscopically observed in the same manner as stated for Note 3. The state of worn edge portion was evaluated according to the following three criteria.

A : Uniformly worn edge

B : Locally ragged worn edge

C : Ragged worn edge with irregularities

Table 1 reveals that Examples 1 to 3 of the invention achieved higher abrasion resistance than Comparative Examples 1 and 2, and that Examples of the invention also attained higher antifilming properties. Table 1 further indicates that these excellent results are closely related with uniform wear. The overall test result shows that Examples 1 to 3 gave copy images of higher quality than Comparative Examples 1 and 2 and that the cleaning blades of the invention have a longer life.

The cleaning blade of Comparative Example 3 having two layers of different hardnesses has a shorter life than those of the invention wherein the two layers have the same or substantially the same hardness. The shorter life appears attributable to the concentration of stress on one of the two members. The single-layer cleaning blade of Comparative Example 4 made of a material other than polymer A is apparently much inferior to those of the invention.

COMPARATIVE EXAMPLES 5 AND 6

Two kind of cleaning blades of double-layer structure were prepared using polymer $A_2$ for the contact member and using for the support member urethane elastomers (polymers $B_5$ and $B_6$) not lower than polymer A in glass transition temperature as listed in Table 2. Table 2 shows that Comparative Examples 5 and 6 resulted in somewhat lower cleaning ability than Example 2 of the invention.

TABLE 2

| | | Ex. 2 | Com. Ex. 5 | Com. Ex. 6 |
|---|---|---|---|---|
| Contact member | material | polymer $A_2$ | polymer $A_2$ | polymer $A_2$ |
| | hardness (JIS-A) | 77 | 77 | 77 |
| | Tg(°C.) | −36 | −36 | −36 |
| Support member | material | polymer $B_2$ | polymer $B_5$ | polymer $B_6$ |
| | hardness (JIS-A) | 77 | 77 | 78 |
| | Tg(°C.) | −43 | −33 | −28 |
| Test at 0° C. (*4) | | | | |
| (a) | Width of wear after 10,000 copying cycles (*5) | 0.90 | 0.97 | 1.00 |
| (b) | Cleaning ability | good | partially slightly poor | partially slightly poor |

In the above, polymers $B_5$ and $B_6$ are prepared by the following formulations.

| | |
|---|---|
| Polymer $B_5$: | |
| Prepolymer obtained from Nippollan 4002 (5 kg) and MDI (5 kg) | 10.0 kg |
| Nippollan 4002 | 2.488 kg |
| Placcel 320 | 3.328 kg |
| 1,4-Butanediol | 0.824 kg |
| Polymer $B_6$: | |
| The same prepolymer as in polymer $B_5$ | 10.0 kg |
| Nippollan 4002 | 3.247 kg |
| Placcel 312 | 2.002 kg |
| 1,4-Butanediol | 0.765 kg |

In the above, Nippollan 4040, 4070 and 4002 are polyesterpolyol manufactured by Nihon Polyurethane Co., Ltd., Placcel 320, 330 and 312 are lactone-type polyesterpolyol manufactured by Daicel Chemical Industry Co., Ltd. and MDI is Millionate MT manufactured by Nihon Polyurethane Co., Ltd.

Note 4 (*4): Tested at 0° C.

Note 5 (*5): Relative to the width of wear of Comparative Example 6 taken as 1.00.

The present invention provides a cleaning blade which is characterized in that it has a double-layer structure and comprises a contact member made of a poly(urethane)ureamide polymer and to be held in contact with a toner image bearing member, and a support member for the contact member having the same hardness or substantially the same hardness as the contact member and lower than the contact member in glass transition temperature. The blade has a contact edge of high abrasion resistance and a satisfactory antifilming property and retains the desired cleaning ability over a prolonged period of time. The blade exhibits high cleaning ability for a prolonged period also at low temperatures.

We claim:

1. A cleaning blade for use in electrophotographic copying machines, facsimile machines, printers or the like which is characterized in that it has a double-layer structure and comprises a contact member made of a poly(urethane)ureamide polymer and to be held in contact with a toner image bearing member, and a support member for the contact member having the same hardness or substantially the same hardness as the contact member and lower than the contact member in glass transition temperature.

2. A cleaning blade as defined in claim 1 wherein the poly(urethane)ureamide polymer contains a polymer obtained by the reaction of a polyesterpolyol derivative with a polyisocyanate, the polyesterpolyol derivatives being represented by the formula [I]

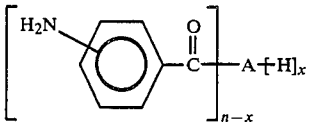

[I]

wherein A is a polyesterpolyol residue having a valence of n and obtained by removing the terminal H atom from a polyesterpolyol having a valence of n and a molecular weight of 400 to 10,000 and containing

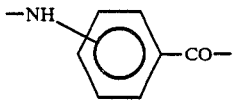

group in its main chain, n is an integer of 2 to 4, and X is an average value of 0 to (n−1), the group —NH— in the group

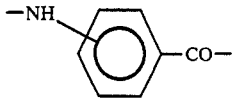

being adjacent to the carbonyl residue of aminobenzoic acid and/or the carbonyl residue of a polybasic acid of polyesterpolyol to form an amido group, the group —CO— forming an ester group or amido group.

3. A cleaning blade as defined in claim 2 wherein the polymer is obtained by further reacting a chain extender having a molecular weight up to 400, in the reaction of the polyesterpolyol derivative and the polyisocyanate.

4. A cleaning blade as defined in claim 2 wherein the polymer is obtained by further reacting a long-chain polyol, long-chain polyamine and/or long-chain aminopolyol, each having a molecular weight of more than 400, in the reaction of the polyesterpolyol derivative and the polyisocyanate.

5. A cleaning blade as defined in claim 1 wherein the hardness of the contact member is in the range of 60 to 90 in JIS-A hardness.

6. A cleaning blade as defined in claim 1 wherein the support member is formed by urethane elastomer, silicone elastomers, flexible epoxy resin elastomer or flexible nylon resin elastomer.

7. An electrphotographic copying machine which is provided with the cleaning blade of claim 1.

8. A facsimile machine which is provided with the cleaning blade of claim 1.

9. A printer which is provided with the cleaning blade of claim 1.

* * * * *